US007982673B2

(12) United States Patent
Orton et al.

(10) Patent No.: US 7,982,673 B2
(45) Date of Patent: Jul. 19, 2011

(54) ELECTROMAGNETIC BAND-GAP STRUCTURE

(75) Inventors: Richard Stanley Orton, Chelmsford (GB); Thomas Robin Leach, Sheffield (GB)

(73) Assignee: BAE SYSTEMS plc, London (GB)

( * ) Notice: Subject to any disclaimer, the term of this patent is extended or adjusted under 35 U.S.C. 154(b) by 56 days.

(21) Appl. No.: 11/992,348

(22) PCT Filed: Aug. 10, 2007

(86) PCT No.: PCT/GB2007/050481

§ 371 (c)(1), (2), (4) Date: Jun. 16, 2009

(87) PCT Pub. No.: WO2008/020249

PCT Pub. Date: Feb. 21, 2008

(65) Prior Publication Data

US 2009/0295665 A1 Dec. 3, 2009

(30) Foreign Application Priority Data

Aug. 18, 2006 (EP) ..... 06270081

Aug. 18, 2006 (GB) ..... 0616391.9

(51) Int. Cl.
*H01Q 1/38* (2006.01)

(52) U.S. Cl. ..... 343/700 MS; 343/909

(58) Field of Classification Search ..... None
See application file for complete search history.

(56) References Cited

U.S. PATENT DOCUMENTS

| | | | | |
|---|---|---|---|---|
| 6,411,261 | B1 | 6/2002 | Lilly | |
| 6,670,921 | B2 * | 12/2003 | Sievenpiper et al. | 343/700 MS |
| 6,774,867 | B2 * | 8/2004 | Diaz et al. | 343/909 |
| 6,917,343 | B2 * | 7/2005 | Sanchez et al. | 343/795 |
| 7,042,419 | B2 * | 5/2006 | Werner et al. | 343/909 |
| 7,145,518 | B2 * | 12/2006 | Tanaka et al. | 343/909 |
| 2003/0122729 | A1 * | 7/2003 | Diaz et al. | 343/909 |
| 2004/0160367 | A1 | 8/2004 | Mendolia et al. | |

FOREIGN PATENT DOCUMENTS

| | | |
|---|---|---|
| WO | WO 02/41447 | 5/2002 |
| WO | WO 02/069447 | 9/2002 |
| WO | WO 03/007427 | 1/2003 |

OTHER PUBLICATIONS

International Search Report, from PCT International Patent Application No. PCT/GB2007/050481, filed Aug. 10, 2007.

(Continued)

*Primary Examiner* — Trinh V Dinh

(74) *Attorney, Agent, or Firm* — Kenyon & Kenyon LLP

(57) ABSTRACT

An electromagnetic band gap structure is provided including a ground plane and a periodic planar arrangement of surface elements mounted parallel to and at a predetermined distance from the ground plane. Each of the surface elements is supported in the planar arrangement by at least one conducting support element extending from an edge of the surface element to the ground plane, avoiding back-to-back parallel support elements. This arrangement allows for the surface elements and their respective support elements to be folded from flat metal templates to greatly simplify manufacture. An antenna is also provided in which an antenna element is mounted in such a way as to use the electromagnetic band-gap structure as a ground plane. This allows for a low-profile antenna to be made as the antenna element may be mounted close to the plane of surface elements in the structure.

10 Claims, 7 Drawing Sheets

OTHER PUBLICATIONS

U.K. Patent Office, Search Report, Nov. 30, 2006, from related UK Patent Application No. GB 06270081.0, filed Aug. 18, 2006.

European Patent Office, European Search Report, Jan. 18, 2007, from related European Patent Application No. EP 0616391.9, filed Aug. 18, 2006.

European Patent Office, International Preliminary Report on Patentability and Written Opinion, Feb. 24, 2009, from International Patent Application No. PCT/GB2007/050481, filed on Aug. 10, 2007.

Ying et al., "Study of Different Realizations and Calculation Models for Soft Surfaces by Using a Vertical Monopole on a Soft Disk as a Test Bed," Nov. 1996, IEEE Transactions on Antennas and Propagation, vol. 44, No. 11, pp. 1474-1481.

Sievenpiper et al., "High-Impedance Electromagnetic Surfaces with a Forbidden Frequency Band," Nov. 1999, IEEE Transactions on Microwave Theory and Techniques, vol. 47, No. 11, pp. 2059-2074.

* cited by examiner

ELECTROMAGNETIC BAND-GAP STRUCTURE

RELATED APPLICATION INFORMATION

This application is a United States National Phase Patent Application of, and claims the benefit of, International Patent Application No. PCT/GB2007/050481 which was filed on Aug. 10, 2007, and which claims priority to British Patent Application No. 06270081.0, which was filed on Aug. 18, 2006, and which claims priority to European Patent Application No. 0616391.9, which was filed on Aug. 18, 2006, the disclosures of all of which are incorporated herein by reference.

FIELD OF THE INVENTION

The present invention relates to electromagnetic band-gap structures and in particular, but not exclusively, to an improved structure operable as a high impedance surface for use in low-profile antenna applications operating with electromagnetic radiation in the frequency range 100 MHz to 1 GHz.

BACKGROUND INFORMATION

In an arrangement, discussed for example by D. Sievenpiper, L. Zhang, R. F. J. Broas, N. G. Alexopolous and E. Yablonovitch in "High-Impedance Electromagnetic Surfaces with a Forbidden Frequency Band," IEEE Trans. On Microwave Theory and Technology, Vol. 47, No. 11, November 1999, a high impedance surface has been created using a structure in the form if a close-packed periodic array of square-topped "thumb tack" or mushroom-shaped metal elements connected a ground plane surface by means of vias. A representation of the structure of Sievenpiper et al. is shown in FIG. 1. This structure is intended for use with signals of microwave frequency, usually defined to lie in the region of the electromagnetic spectrum between infra-red and radio waves and so of frequency in the range of 1 to 300 GHz typically. The structure shown in FIG. 1 is therefore typically of a scale that allows for fabrication using printed circuit techniques.

If the structure described by Sievenpiper et al. were to be scaled up in size to be suitable for use with signals in the range of 100 MHz to 1 GHz, the result would be a bulky and heavy structure.

SUMMARY OF THE INVENTION

From a first aspect, the present invention resides in a electromagnetic band-gap structure, including:

an electrically conducting ground plane; and a periodic planar arrangement of electrically conducting surface elements mounted parallel to and at a predetermined distance from the ground plane, wherein each of the surface elements is supported in said planar arrangement by at least one electrically conducting support element extending from an edge of the surface element to the ground plane and wherein for no two adjacent surface elements are their respective support elements disposed in a parallel back-to-back arrangement.

Electromagnetic band-gap structures according to this first aspect of the present invention include a periodic array of unit cells, each unit cell including at least one electrically conducting surface element of a close-packing shape supported at its edge and electrically connected to an electrically conducting ground plane by at least one electrically conducting support element. The support elements are placed so that for no two adjacent surface elements are their support elements arranged in close proximity to one another in a parallel back-to-back arrangement. This has the advantage that undesirable or unpredictable effects affecting the performance of the structure as a high impedance surface at a desired frequency may be avoided. Support elements of adjacent surface elements may be arranged parallel to one another so long as they are placed apart, for example at non-adjacent edges of the adjacent surface elements.

Advantageously, this particularly simple form of structure enables a high impedance surface to be constructed much more easily and with less expense than known high impedance surfaces designed for use in the frequency range of 100 MHz to 1 GHz.

The surface elements may all be of the same close-packing shape. Close packing shapes that may be used where all the surface elements are of the same shape include triangles, squares and hexagons. However, in an alternative embodiment, a mixture of different shapes may be used to achieve a close-packed arrangement of surface elements. In an example that makes use of two different shapes for the surface elements, a periodic arrangement of octagons and squares may be used. Of course any periodic combination of shapes may in theory be used that results in a close-packed arrangement of surface elements. However, there may be a corresponding reduction in the ease of manufacture of structures using more complex arrangements of shapes.

In the arrangement of Sievenpiper et al. for example, as shown in FIG. 1, a high impedance surface 100 includes an arrangement of surface elements 105 connected to a ground plane 110 by means of vias 115. However, in the present invention, the surface elements are connected to the ground plane and supported at one or more of their edges by flat metal support elements which can be arranged at approximately 90° to the ground plane and to the plane of surface elements. The surface elements and their support elements may be folded from flat metal templates, greatly simplifying their manufacture in comparison with a structure made according to the design referenced above.

Where the support elements are square, the support elements of any two adjacent surface elements may be disposed at right angles to one another. This provides for a more uniform structure.

Electromagnetic band-gap structures according to the first aspect of the present invention may be designed for use with electromagnetic signals in the frequency range 100 MHz to 1 GHz.

From a second aspect, the present invention resides in an antenna, including an antenna element mounted on an electromagnetic band-gap structure defined according to the first aspect above, wherein the electromagnetic band-gap structure is arranged to operate as a high impedance surface at an operating frequency of the antenna and hence as a ground plane for the antenna.

Advantageously, structures according to exemplary embodiments of the present invention are structurally and electromagnetically similar in more than one direction, for example in the x direction and the y direction, parallel to the edges of the surface elements in the case of square surface elements. Thus a dipole antenna would be substantially unaffected by its mounting orientation on the surface of the structure, enabling crossed dipole antennae to be mounted for example.

Structures according to exemplary embodiments of the present invention may be filled with a light-weight dielectric foam material in order to increase their robustness and rigidity without adding significantly to their weight. This is of particular advantage in those embodiments in which surface elements are supported by only one edge.

From a third aspect, the present invention resides in a low-profile antenna, including an antenna as defined according to the second aspect above, further including an antenna element mounted parallel to and at a level substantially coincident with the plane of surface elements in the electromagnetic band-gap structure.

F*igure* 10 shows a perspective view of an antenna element according to an exemplary embodiment of the present invention.

DETAILED DESCRIPTION

Exemplary embodiments of the present invention will now be described in more detail, by way of example only, with reference to the accompanying drawings.

Electromagnetic band-gap (EBG) structures according to exemplary embodiments of the present invention have been designed to provide a high-impedance surface to electromagnetic radiation at selected frequencies in the range 100 MHz to 1 GHz in particular. These EBG structures are particularly suited for application to low-profile antennae in which they are used to provide a ground plane. At frequencies in the range 100 MHz to 1 GHz, known high-impedance surfaces require large and heavy structures. However, exemplary embodiments of the present invention aim to provide a light-weight structure and one that is simple and inexpensive to make.

An EBG structure according to an exemplary embodiment of the present invention will now be described with reference to FIG. 2.

Figure 1:
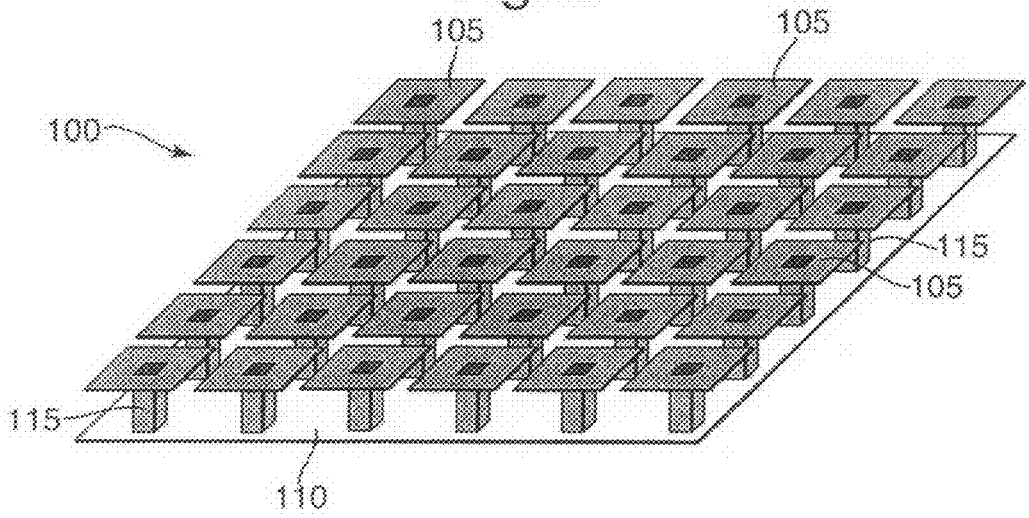
FIG. 1 shows an electromagnetic band-gap structure.
Figure 2:
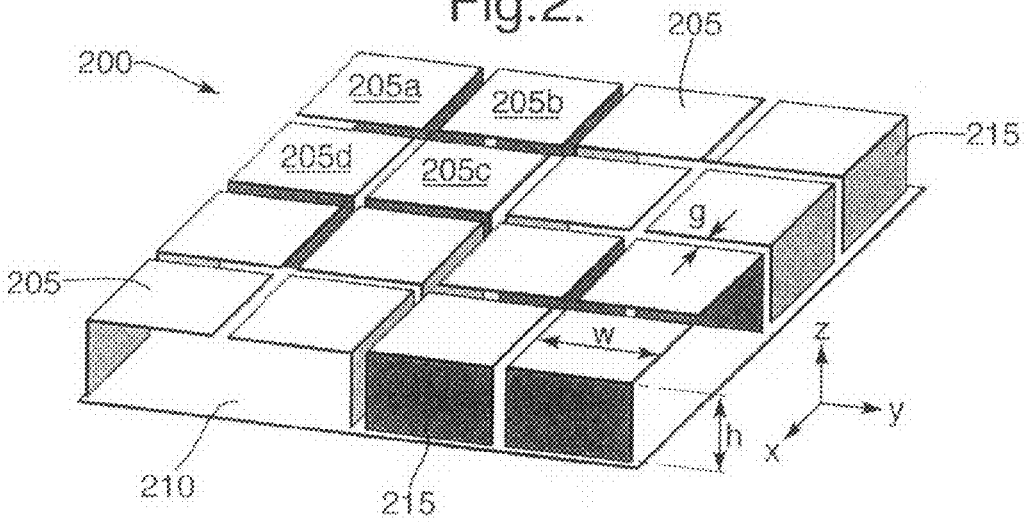
FIG. 2 shows an electromagnetic band-gap structure according to an exemplary embodiment of the present invention.

Referring to FIG. 2, a perspective view of a portion of an EBG structure 200 is shown including a periodic arrangement of square surface elements 205, each of width w and each one separated from its adjacent plates 205 by a distance g. Each surface element 205 is connected to a ground plane 210 and supported by one edge at a height h above and parallel to the ground plane 210 by a support element 215. Each support element 215 may be oriented at substantially 90° to the ground plane 210 and to the surface element 205 that it supports. The surface elements 205 may be manufactured as groups of four adjacent elements, each group of four elements forming what will be referred to as a unit cell. One of these unit cells is represented in FIG. 2 by the surface elements 205*a*, 205*b*, 205*c*, 205*d* and their support elements 215. By adjusting the dimensions w, g and h, the structure 200 may be arranged to behave as a high-impedance surface over a required frequency range. The techniques for determining appropriate values for w, g and h are well known in the art and will not be described here. Further information on the theory and practice of high impedance surfaces applicable to that of the present invention may be found in the document of Sievenpiper et al. referenced above.

The EBG structure 200 operates on the basis of a parallel resonant LC circuit in which resonance occurs when $\omega_0^2=1/LC$. The basis of operation of the EBG structure 200 as a high-impedance surface can be understood in more detail with reference to FIG. 3 in which a perspective view of a small portion of the structure 200 is shown.

Figure 3:
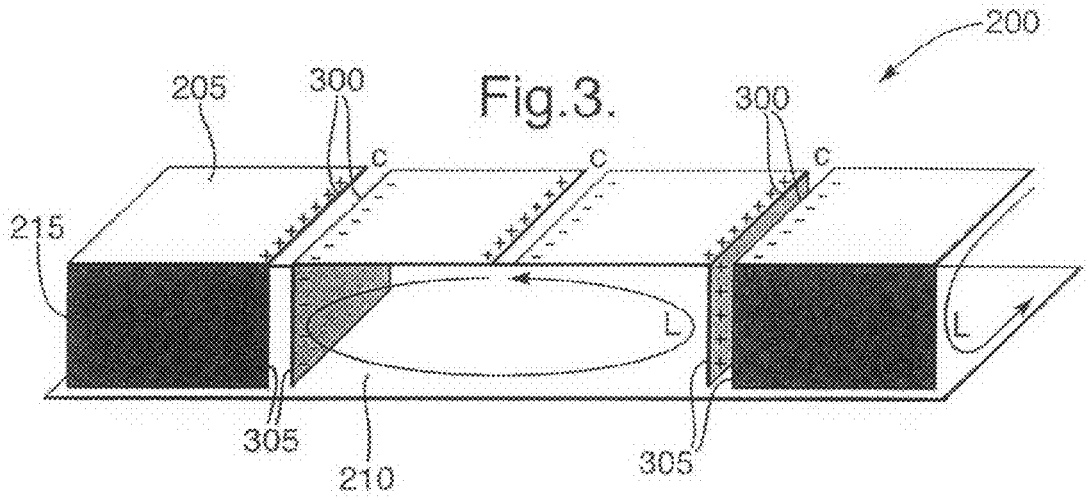
FIG. 3 shows a portion of the structure of FIG. 1 for the purpose of explaining its behavior as a high impedance surface.

Referring to FIG. 3, capacitance C is shown to exist between adjacent edges 300 of the surface elements 205, and also between adjacent edges 305 of the support elements 215. Inductance L arises in the structure 200 when magnetic fields are created by current flowing through the support elements 215 and the ground plane 210. These capacitance and inductance properties are not confined to one unit cell or another, but also arise between unit cells across the structure 200.

In an application of the EBG structure 200, the structure 200 is required to behave as a high impedance surface at the frequency of operation of an antenna and so provide a suitable ground plane to enable a low-profile antenna to be constructed, as will now be described with reference to FIG. 4.

Figure 4:
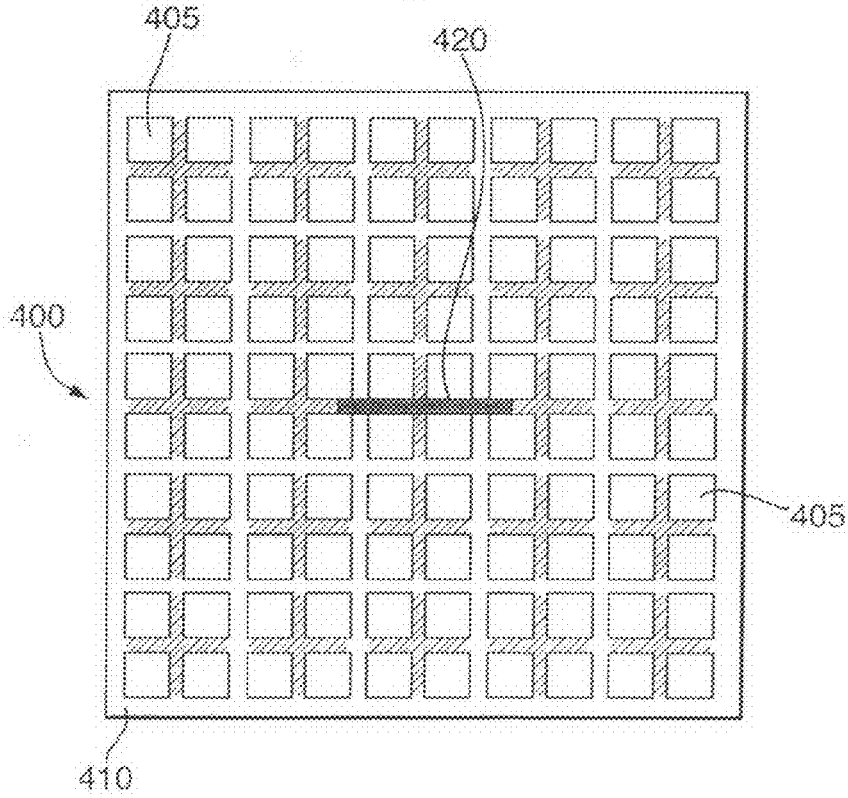
FIG. 4 shows a plan view of a low-profile antenna including a structure according to an exemplary embodiment of the present invention.

Referring to FIG. 4, a plan view is provided of a low profile antenna structure 400, from a direction perpendicular to the plane of the structure 400, including an EBG structure similar to that of FIG. 2. The structure 400 includes a 5×5 array of unit cells of the type (205*a-d*) shown in FIG. 2, providing a periodic structure of square surface elements 405 supportably connected to a ground plane 410. An antenna 420 including antenna elements with a total length that is half the intended operating wavelength of the antenna 420 is installed in the centre of the structure 400. The antenna 420 may be mounted at substantially the same height above the ground plane 410 as that of the surface elements 405 above the ground plane 410, a small gap may be provided so as to avoid actual contact with the underlying surface elements 405.

By way of example, if a low-profile antenna structure 400 is required for operation with signals of frequency 432 MHz, then the EBG structure is required to have a band-gap at 432 MHz in which the phase of its reflection coefficient is 0°, so imitating the behavior of a perfect magnetic conductor (PMC) at that frequency. To achieve this with a 5×5 unit cell EBG structure as shown in FIG. 4, the dimensions referred to above may be determined using standard techniques to be: w=128 mm, g=8 mm, and h=80 mm. The half-wavelength antenna 420 is approximately 700 mm long and is mounted at a height of 80 mm above and parallel with the ground plane 410. The unit cell components may be constructed from aluminium sheet 1.5 mm thick and the ground plane 410 is constructed from aluminium sheet 3 mm thick.

Conventionally, a radiating dipole antenna would need to be mounted approximately 174 mm above a perfect electric conductor (PEC) ground plane for operation at 432 MHz. Hence, mounting the antenna 420 above an EBG structure according to an exemplary embodiment of the present invention reduces the overall height of the antenna by approximately 94 mm in this particular example.

Conveniently, each of the unit cells of the EBG structure 200 of FIG. 2 or that (400) of FIG. 4 may be constructed using flat metal sheet templates. Each flat metal template is designed to be folded along predetermined fold lines to form the 3D structure of a unit cell. Once folded into shape, each unit cell may be bolted or otherwise fixed to a metal ground plane at a required spacing. Examples of templates and the corresponding unit cells will now be described according to exemplary embodiments of the present invention, beginning, as shown in FIG. 5, with a template for making unit cells used in the EBG structures 200 and 400 described above.

Figure 5:
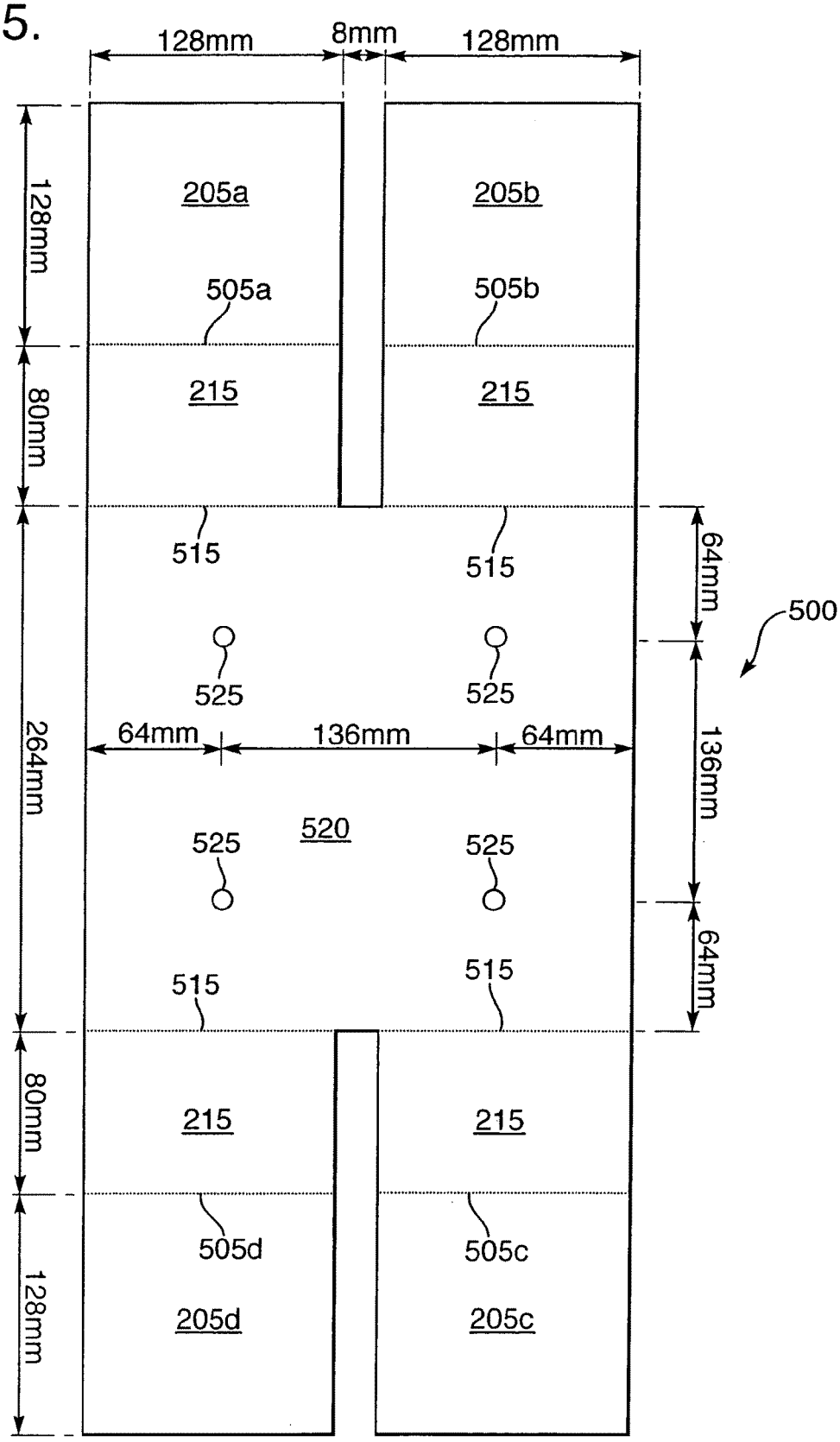
FIG. 5 shows a flat metal template for use in constructing unit cells that make up the structure in an exemplary embodiment of the present invention.

Referring to FIG. 5, and further with reference to FIG. 2, a flat metal sheet template 500 is shown from which a unit cell including the surface elements 205*a-d* may be constructed. The template 500 is shown with dimensions marked by way of example for making a unit cell according to the particular 432 MHz low-profile antenna embodiment described above with reference to FIG. 4. The surface elements 205*a-d* are formed by folding along fold lines 505*a-d*, respectively, each through substantially 90°. The support elements 215 are formed by folding along the fold lines 515, also through substantially 90°, and in the same folding direction as for the respective adjacent fold line 505*a-d*, to complete the unit cell. A base 520 of the unit cell may be drilled to form fixing holes 525 to enable the unit cell to be bolted or otherwise attached to the ground plane 210.

Figure 6:
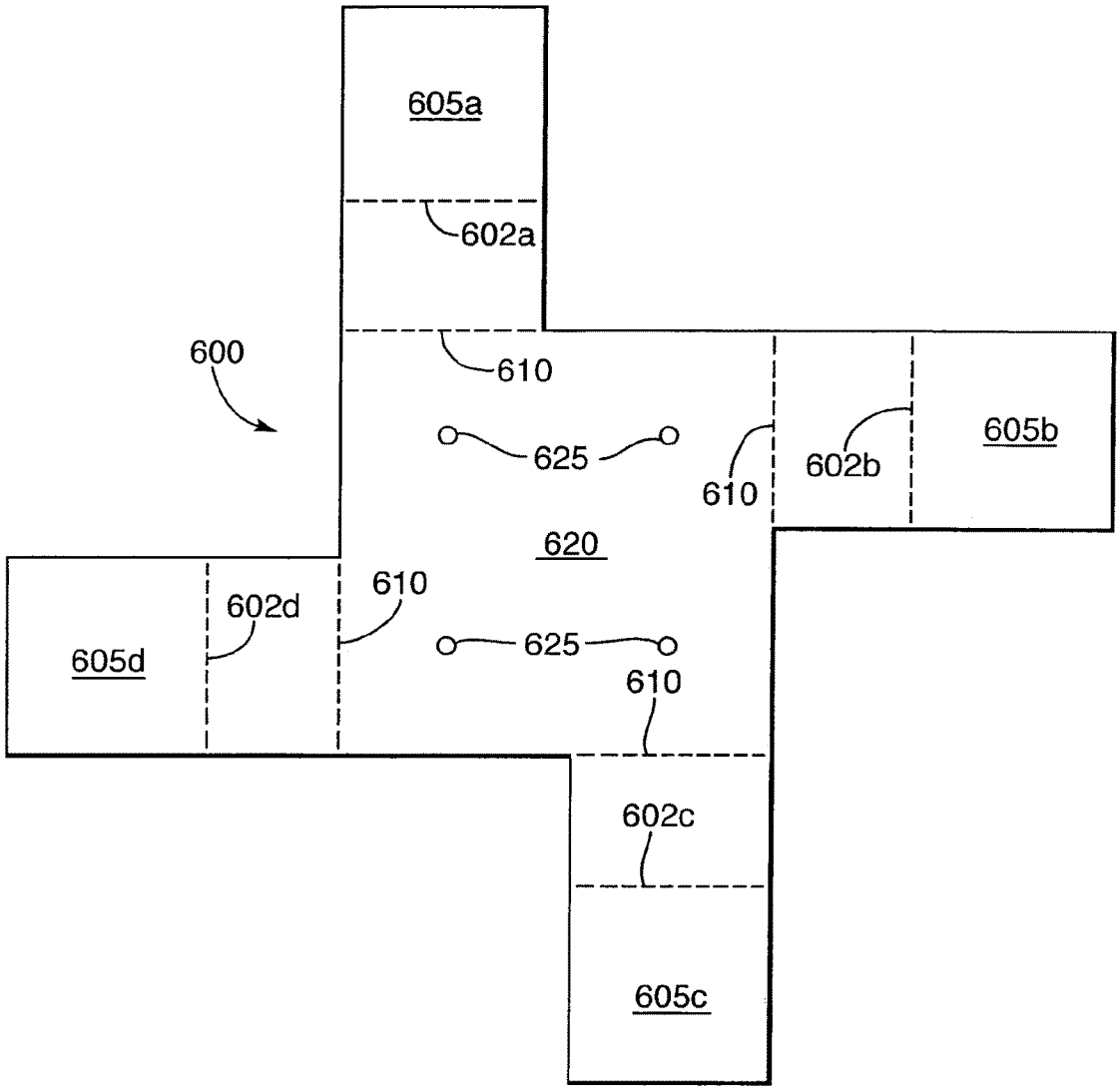
FIG. 6 shows a flat metal template for use in constructing unit cells that make up the structure according to an exemplary embodiment of the present invention.

Referring to FIG. 6, a further template 600 is shown for making a unit cell based upon square surface elements that is similar to that used in the structure 200 of FIG. 2, but with a different arrangement of support elements 215. In the template 600, folding along fold lines 605*a-d* through substantially 90° results in surface elements 605*a-d* similarly disposed to those plates 205*a-d* of FIG. 2. However, after folding along lines 610 through substantially 90° in the same folding direction as for the respective adjacent fold line 605*a-d*, the arrangement of support elements 615 around the base 620 of the unit cell is different to that resulting with the template 500 of FIG. 5. Fixing holes 625 may be drilled through the base 620 to enable fixing of the unit cell to the ground plane 210, as above, ensuring that no two support elements 615 of adjacent unit cells are in a back-to back parallel arrangement. An exemplary arrangement of unit cells constructed from the template 600 of FIG. 6, after fixing to a ground plane 210, is shown in FIG. 7.

Figure 7:
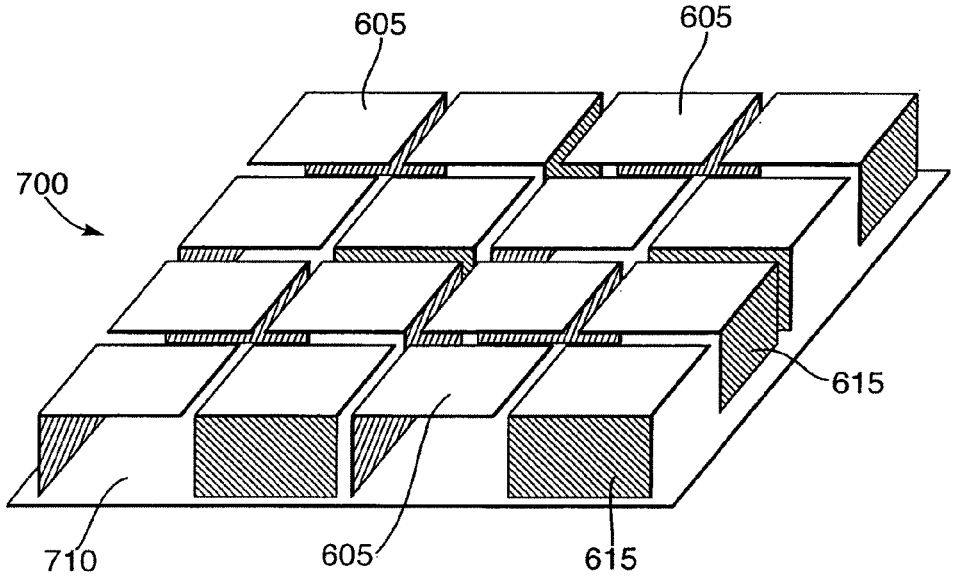
FIG. 7 shows an electromagnetic band-gap structure according to an exemplary embodiment of the present invention.

Referring to FIG. 7, a perspective view of an EBG structure 700 is shown, constructed from unit cells folded from the template 600 of FIG. 6. As can be seen, the arrangement of surface elements 605 above the ground plane 710 is similar to that in the structure 200 of FIG. 2, but the arrangement of supporting upright plates 615 is different to that involving the support elements 215 of FIG. 2. Nevertheless, the dimensions required to achieve the characteristics of a high impedance surface at a desired frequency are similar to those for the EBG structure 200 of FIG. 2 as described above given that the structure 700 possesses similar characteristics of capacitance and inductance as the structure 200.

Whereas the EBG structures 200, 400, 700 in exemplary embodiments of the present invention use square surface elements 205, 405, 605, close-packing shapes other than squares may also be used for the surface elements, as would be apparent to a person of ordinary skill in this field. In particular, periodic arrangements of triangular or hexagonal surface elements may be used with various arrangements of support elements to connect them to a ground plane. Alternatively, close-packed arrangements may be realized with combinations of surface elements of different shapes, for example octagons and squares. In a further exemplary embodiment of the present invention, an arrangement based upon the use of hexagonal surface elements will now be described with reference to FIG. 8.

Figure 8:
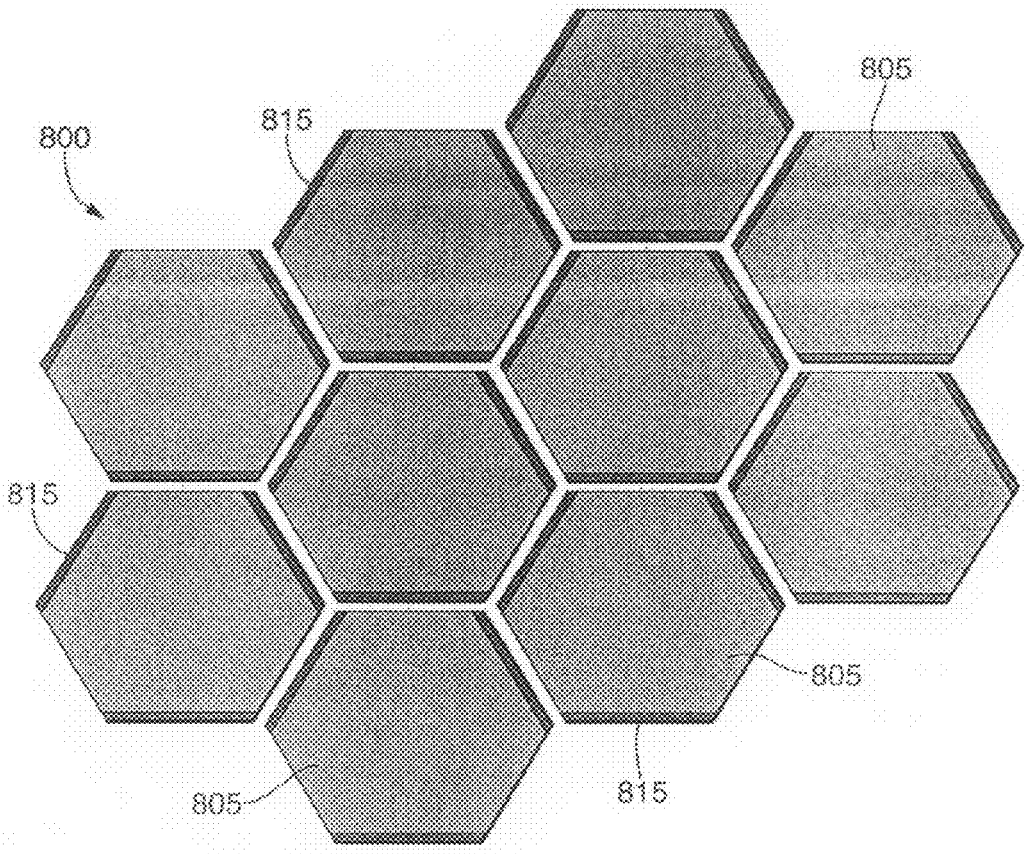
FIG. 8 shows a plan view of an electromagnetic band-gap structure according to an exemplary embodiment of the present invention.

Referring to FIG. 8, a representational view is provided of an EBG structure 800, viewed from a direction perpendicular to a surface including a periodic arrangement of hexagonal surface elements 805, rather than square surface elements 205 as in FIG. 2 or 405 as in FIG. 4. Each of the hexagonal surface elements 805 may be supported by three support elements 815. However, only one or two support elements 815 may be used, alternatively, though with some loss of rigidity in the structure 800. An exemplary arrangement of the support elements 815 is shown in FIG. 8, consistent with the rule that no pair of support elements 815 of adjacent unit cells—a unit cell in this embodiment including a single hexagonal surface element 805 and its support elements 815—shall lie in a back-to-back parallel arrangement.

In the EBG structure 800 of FIG. 8, each unit cell may be folded from a flat metal template as for the unit cells based upon a square surface element 205, 405, 605 in exemplary embodiments described above. An exemplary template for the unit cell in FIG. 8 is shown in FIG. 9.

Figure 9:
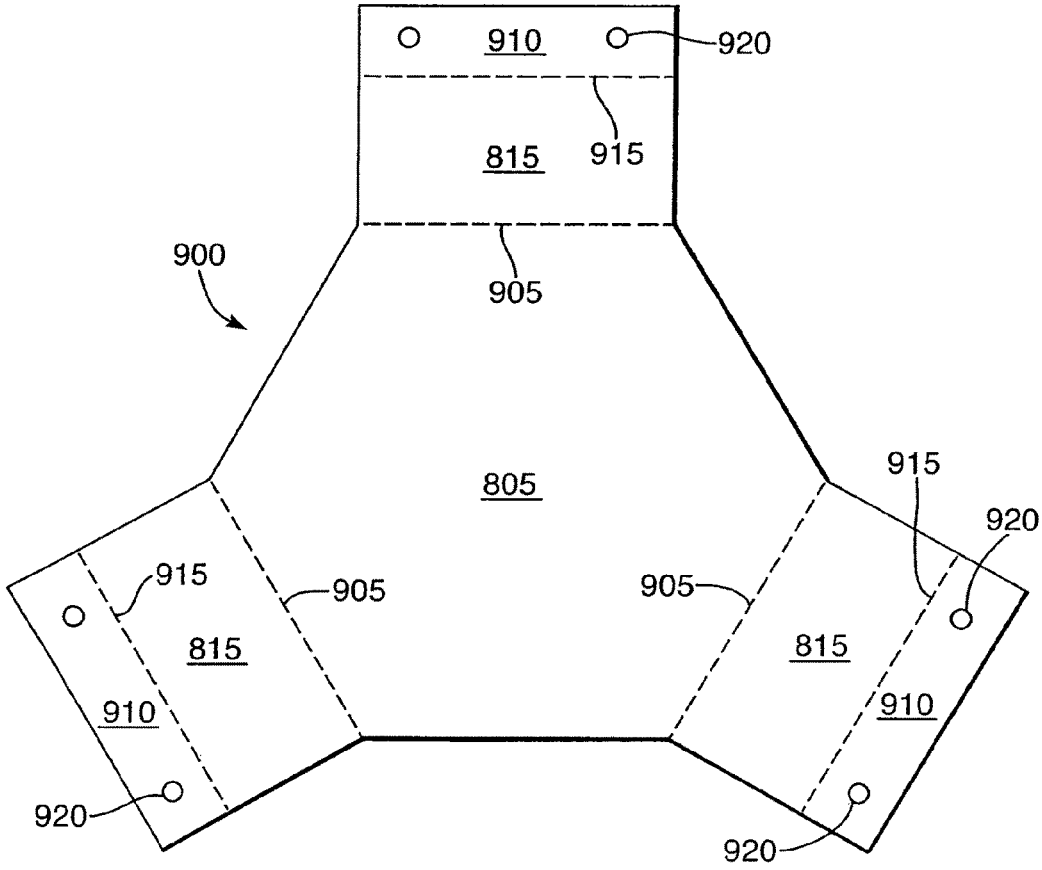
FIG. 9 shows a flat metal template for use in constructing unit cells that make up the structure according to an exemplary embodiment of the present invention.

Referring to FIG. 9, a flat metal template 900 is shown for use in constructing unit cells based upon a single hexagonal surface element 805 with three support elements 815. Each of the support elements is formed by folding along a fold line 905 through substantially 90°. For convenience, mounting flanges 910 may be formed by making a further fold through substantially 90° along a respective adjacent fold line 915, the fold may be in the same folding direction as for the adjacent fold fine 905. Fixing holes 920 may be drilled in the mounting flanges 910 to enable each unit cell to be securely attached to a ground plane to form the EBG structure 800 shown in FIG. 8.

As will be apparent to a person of ordinary skill in the relevant field, templates of other designs may be made to create alternative arrangements of surface elements and their respective support elements, according to the shape or shapes of surface elements required. Furthermore, unit cells including different numbers of surface elements to those unit cells defined above may be chosen and the corresponding templates designed for their manufacture.

An exemplary antenna element 405 for use in a low profile antenna as described above with reference to FIG. 4 will now be described with reference to FIG. 10.

Figure 10:
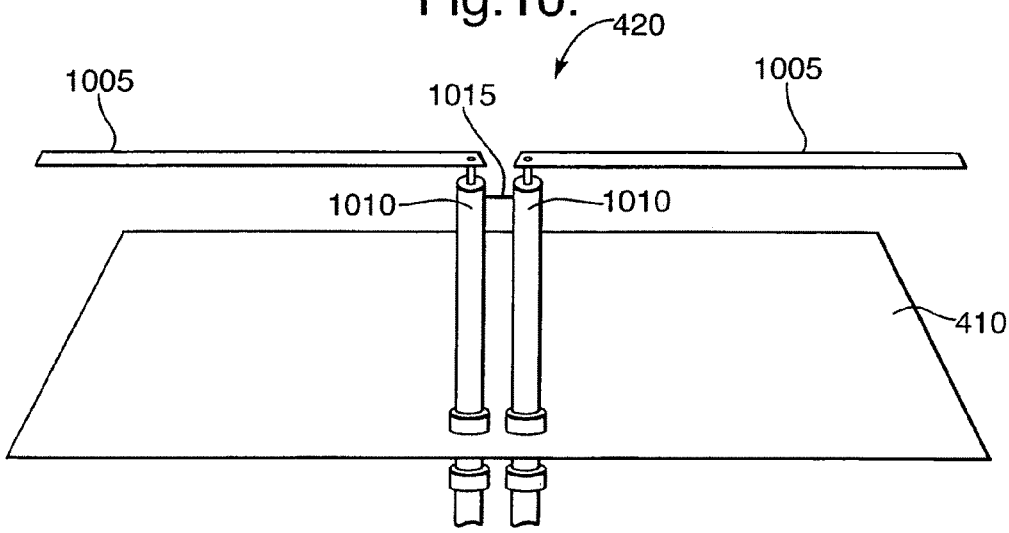

Referring to FIG. 10, a perspective view of an antenna element 405 is provided, in which the antenna element is a dipole antenna having two arms 1005 of length equal to one quarter of the operational wavelength of the antenna, supported and fed in anti-phase (180° phase difference) substantially at the level of the surface elements of a electromagnetic band-gap structure (not shown in FIG. 10) by semi-rigid sections 1010 of co-axial cable. The co-axial cables 1010 pass through and are insulated from the ground plane 410. The outer lines of the co-axial cable sections 1010 may be soldered together at a point 1015 where they terminate.

Other types of antenna may also be used in conjunction with electromagnetic band-gap structures according to exemplary embodiments of the present invention. For example, in the antenna shown in FIG. 10, a simple antenna element may be formed with a single arm of the required length by bending the inner core of a single section 1010 of coaxial cable through 90° at an appropriate height above the ground plane 410. In another example, a crossed dipole arrangement may be mounted above the ground plane 410. Further choices of antenna design would be apparent to a person of ordinary skill in this field and are intended to fall within the scope of the present invention.

While electromagnetic band-gap structures according to exemplary embodiments of the present invention are particularly suited for use in low-profile antennae, antennae that do make use of these structures are not limited to being of the low-profile type.

The invention claimed is:

1. An electromagnetic band-gap structure, comprising:

an electrically conducting ground plane; and a periodic planar arrangement of electrically conducting surface elements mounted parallel to and at a predetermined distance from the ground plane;

wherein:

each of the surface elements is supported in said planar arrangement by at least one electrically conducting flat support element extending from an edge of the surface element to the ground plane, the support elements for each two adjacent surface elements are not disposed in a parallel back-to-back arrangement, and one of the following is satisfied: (a) each of the surface elements is of the same square shape and for adjacent surface elements there are respective support elements which are disposed at an angle of 90° to one another; and (b) each of the surface elements is of the same hexagonal shape and for adjacent surface elements there are respective support elements which are disposed at an angle of 120° to one another.

2. The electromagnetic band-gap structure of claim 1, wherein the surface elements and the respective support elements are formed by folding flat metal sheet templates.

3. The electromagnetic band-gap structure of claim 2, wherein each of the flat metal sheet templates forms a unit cell that includes one or more surface elements and respective support elements.

4. The electromagnetic band-gap structure of claim 3, wherein a unit cell includes four adjacent square surface elements and respective support elements, and a base element.

5. The electromagnetic band-gap structure of claim 4, wherein the support elements of any two adjacent surface elements within the unit cell are disposed at right angles to one another.

6. The electromagnetic band-gap structure of claim 3, wherein a unit cell includes one hexagonal surface element and at least one respective support element.

7. The electromagnetic band-gap structure of claim 1, arranged to operate as a high impedance surface with electromagnetic signals at a frequency in the range 100 MHz to 1 GHz.

8. An antenna, comprising: an antenna element mounted on an electromagnetic band-gap structure, the electromagnetic band-gap structure, including:

an electrically conducting ground plane; and a periodic planar arrangement of electrically conducting surface elements mounted parallel to and at a predetermined distance from the ground plane;

wherein:

each of the surface elements is supported in said planar arrangement by at least one electrically conducting flat support element extending from an edge of the surface element to the ground plane, the support elements for each two adjacent surface elements are not disposed in a parallel back-to-back arrangement, one of the following is satisfied: (a) each of the surface elements is of the same square shape and for adjacent surface elements there are respective support elements which are disposed at an angle of 90° to one another; and (b) each of the surface elements is of the same hexagonal shape and for adjacent surface elements there are respective support elements which are disposed at an angle of 120° to one another, and the electromagnetic band-gap structure is arranged to operate as a high impedance surface at an operating frequency of the antenna and hence as a ground plane for the antenna.

9. The antenna of claim 8, wherein the antenna element is a dipole antenna.

10. A low-profile antenna, comprising:

an antenna element mounted on an electromagnetic band-gap structure, the electromagnetic band-gap structure, including:

a periodic planar arrangement of electrically conducting surface elements mounted parallel to and at a predetermined distance from the ground plane;

wherein:

each of the surface elements is supported in said planar arrangement by at least one electrically conducting fiat support element extending from an edge of the surface element to the ground plane, the support elements for each two adjacent surface elements are not disposed in a parallel back-to-back arrangement, one of the following is satisfied: (a) each of the surface elements is of the same square shape and for adjacent surface elements there are respective support elements which are disposed at an angle of 90° to one another; and (b) each of the surface elements is of the same hexagonal shape and for adjacent surface elements there are respective support elements which are disposed at an angle of 120° to one another, the electromagnetic band-gap structure is arranged to operate as a high impedance surface at an operating frequency of the antenna and hence as a ground plane for the antenna, and a second antenna element mounted parallel to and at a level substantially coincident with the plane of surface elements in the electromagnetic band-gap structure.

* * * * *